US005894287A

United States Patent [19]

An et al.

[11] Patent Number: 5,894,287

[45] Date of Patent: Apr. 13, 1999

[54] POLARIZATION DIVERSITY DEVICE FOR REDUCING FADING EFFECT

[75] Inventors: Kwang-Jin An; Authur Roberts, both of Seoul, Rep. of Korea

[73] Assignee: SamSung Electronics Co., Ltd., Suwon, Rep. of Korea

[21] Appl. No.: 08/774,192

[22] Filed: Dec. 26, 1996

[30] Foreign Application Priority Data

Dec. 26, 1995 [KR] Rep. of Korea ..... 95-56576

[51] Int. Cl.[6] ..... H01Q 3/02; H01Q 1/26; H01Q 3/00; H01Q 13/10

[52] U.S. Cl. ..... 343/700 MS; 343/701; 343/767; 343/770; 343/778; 343/823

[58] Field of Search ..... 343/700 MS, 701, 343/767, 770, 778, 823

[56] References Cited

U.S. PATENT DOCUMENTS

| | | | |
|---|---|---|---|
| 3,665,480 | 5/1972 | Fassett | 343/700 MS |
| 4,125,838 | 11/1978 | Kaloi | 343/700 MS |
| 4,186,347 | 1/1980 | Brockman et al. | 325/305 |
| 4,410,891 | 10/1983 | Schaubert et al. | 343/700 MS |
| 4,538,153 | 8/1985 | Taga | 343/700 MS |
| 4,728,960 | 3/1988 | Lo | 343/700 MS |
| 5,410,749 | 4/1995 | Siwiak et al. | 343/700 MS |
| 5,499,033 | 3/1996 | Smith | 343/700 MS |

OTHER PUBLICATIONS

Microwave journal Jon F. Mcilvenna, Monolithic phase arrays for EHF communications terminals, and p. 116, figures 6 and 7, Mar. 1988.

*Primary Examiner*—Anita Pellman Gross
*Assistant Examiner*—Daniel Stcyr
*Attorney, Agent, or Firm*—Robert E. Bushnell, Esq.

[57] ABSTRACT

A polarization diversity device for reducing a fading effect. The polarization diversity device for reducing a fading effect, which has a microstrip disk type of antenna for outputting a signal received from a first position, in the form of a field dipole polarized in a direction of X, and outputting a signal received from a second position perpendicular to the first position, in the form of a field dipole polarized in a direction of Y, a phase shifter for phase-shifting the signal received from the second position, thereby to set the signal having the most appropriate value to a fading environment of a corresponding channel, and a combiner for combining the signal received from the first position, with the signal outputted from the phase shifter.

10 Claims, 2 Drawing Sheets

POLARIZATION DIVERSITY DEVICE FOR REDUCING FADING EFFECT

CLAIM OF PRIORITY

This application makes reference to, incorporates the same herein, and claims all benefits accruing under 35 U.S.C §119 from an application entitled *Polarization Diversity Device For Reducing Fading Effect* earlier filed in the Korean Industrial Property Office on Dec. 26, 1995, and there duly assigned Serial No. 56576/1995 by that Office.

BACKGROUND OF THE INVENTION

1. Field of the Invention

The present invention relates to a polarization diversity device and, more particularly, to a polarization diversity device for reducing fading effects during radio reception.

2. Description of the Related Art

Generally, fading occurs when a reception field intensity varies periodically due to interfering radio waves two or more different channels or by a change in condition of the received radio communication. Width of the fading (width change) reaches from nearly 0 dB to beyond 10 dB, and a cycle thereof reaches from one second to several hours.

Various methods have been used in the prior art to reduce a fading effect under such a fading environment. One of such methods is a diversity method which uses two antennas and selects one antenna at a certain time point. Such conventional diversity method, however, has the disadvantage of utilizing two antennas for reducing the fading effect. Accordingly, the conventional diversity method has additional disadvantages due to the use of two antennas, such as the cost of manufacture being considerably increased and the circuit being made complicated.

The use of polarization diversity is well known in the art for combating losses in different conditions. Polarization diversity consists of using two antennas with responsive orthogonal polarizations to receive or transmit the same signals. U.S. Pat. No. 4,186,347 to Milton H. Brockman, et al., and entitled *Radio Frequency Arraying Method For Receivers* describes the use of two antennas having polarized diversity for increasing signal-to-noise ratio of a receiving facility using power dividers and phase shifters. To overcome the deficiencies related to using two separate antennas, U.S. Pat. No. 5,499,033 entitled *Polarization Diversity Antenna* to Martin S. Smith contemplates the use of a single dual polarized flat plate antenna comprising separate horizontal and vertical flat plate antenna structures superimposed one on the other. Additonally, U.S. Pat. No. 4,410,891 to Daniel H. Schaubert, et al. entitled *Microstrip Antenna With Polarization Diversity* contemplates a single antenna element for constructed to provide complete polarization coverage with the necessity of using power dividers and phase shifters.

SUMMARY OF THE INVENTION

It is therefore an object of the invention to provide a polarization diversity device for reducing a fading effect by performing a polarization diversity using a microstrip disk type of antenna.

Another object is to provide a polarization diversity device directed to the reduction of a fading effect by appropriately combining two signals received from more than two positions on a patch of a single microstrip.

In order to accomplish these and other objects, there is provided a polarization diversity device for reducing a fading effect, which has: a microstrip disk type of antenna for outputting a signal received from a first position, in the form of a field dipole polarized in a direction of X, and outputting a signal received from a second position perpendicular to the first position, in the form of a field dipole polarized in a direction of Y; a phase shifter for phase-shifting the signal received from the second position, thereby to set the signal having the most appropriate value to a fading environment of a corresponding channel; and a combiner for combining the signal received from the first position, with the signal outputted from the phase shifter.

BRIEF DESCRIPTION OF THE DRAWINGS

These and various features and advantages of the present invention will be readily understand with reference to the following detailed description taken in conjunction with the accompanying drawings, wherein.

DETAILED DESCRIPTION OF THE PREFERRED EMBODIMENT

Hereinafter, a preferred embodiment of the present invention will be concretely explained with the accompanying drawings.

Figure 1:
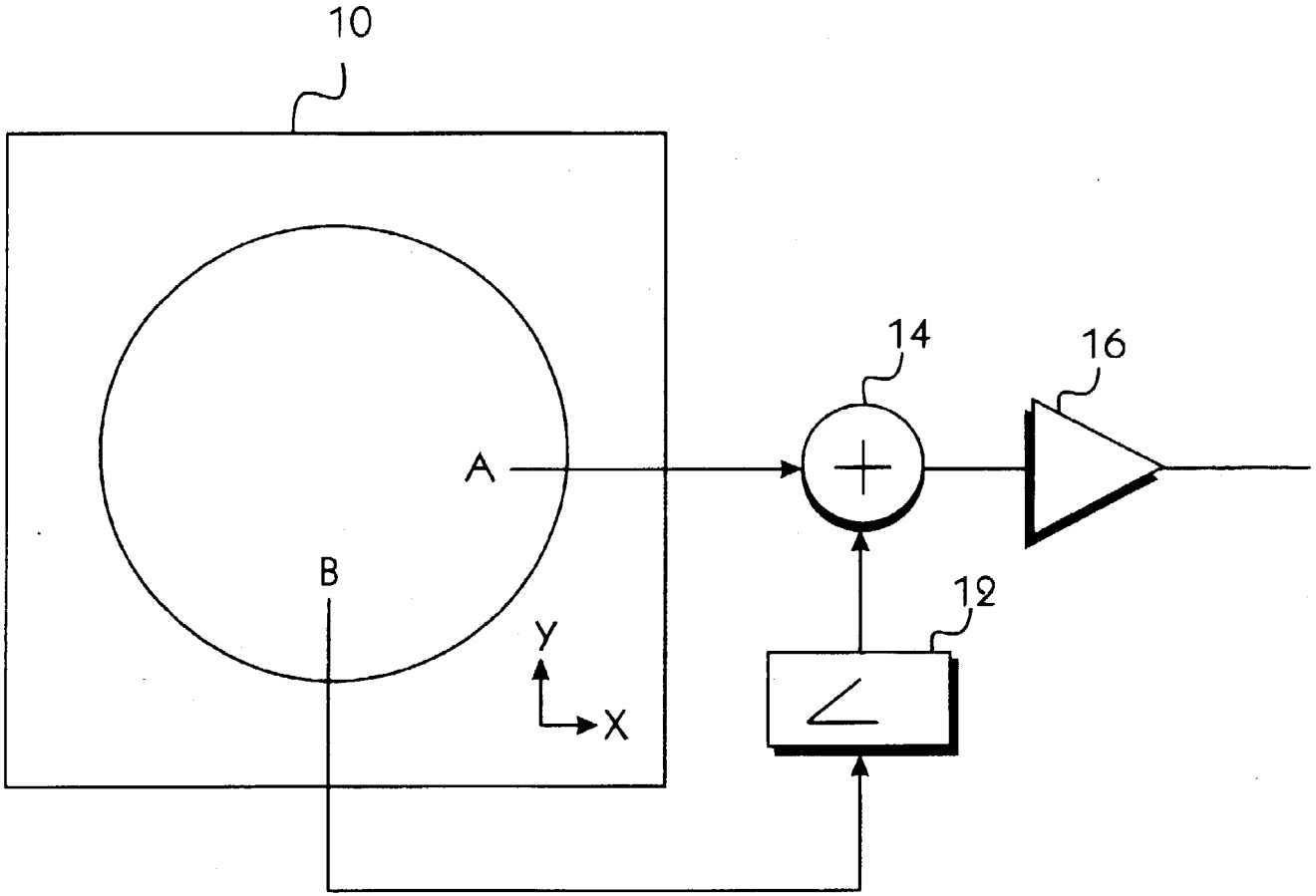
FIG. 1 is a view illustrating a polarization diversity device for performing a polarization diversity, thereby reducing a fading effect, according to the present invention.

FIG. 1 is a view illustrating a polarization diversity device for performing a polarization diversity, thereby reducing a fading effect, according to the present invention. The polarization diversity device comprises a microstrip disk type of antenna 10, a phase shifter 12, a combiner 14 and a low noise amplifier 16. The microstrip disk type of antenna 10 can receive signals at a position A and a position B. The signals received from position A and position B are respectively connected at 50 ohm impeadance positions of the disk. The signal received from position A forms a single phase field dipole at both ends of an X axis without distributing the field at both ends of a Y axis. The signal received from position B forms a single phase field dipole at both ends of the Y axis without distributing the field at both ends of the X axis. Accordingly, the signal received from position A and the signal received from position B are independent to each other. Eventually, the signal received from position A is received in the form of a field dipole polarized in the direction of X, and the signal received form position B is received in the form of a field dipole polarized in the direction of Y. As shown in FIG. 1, the directions X and Y are orthogonal to each other.

The signal received from position B is phase-shifted through phase shifter 12, so that the phase of the signal is set with the most appropriate value to a fading environment of a corresponding channel. The signal is then provided to combiner 14.

The signal received from the position A of antenna 10 and the phase shifted signal output from phase shifter 12 are combined by combiner 14. The combined signal is then provided to low noise amplifier 16. Low noise amplifier 16 amplifies, using noise filter characteristics, the combined signal provided by combiner 14 and outputs an amplified signal having reduced fading for improved reception sensitivity.

Figure 2A:
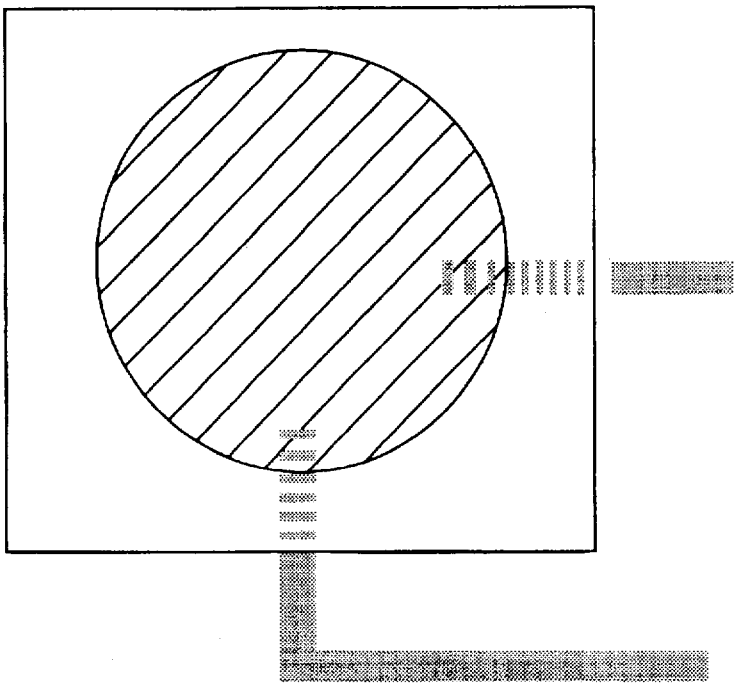
FIGS. 2A and 2B are views illustrating the front side and the rear side of a microstrip disk type of antenna according to the present invention.
Figure 2B:
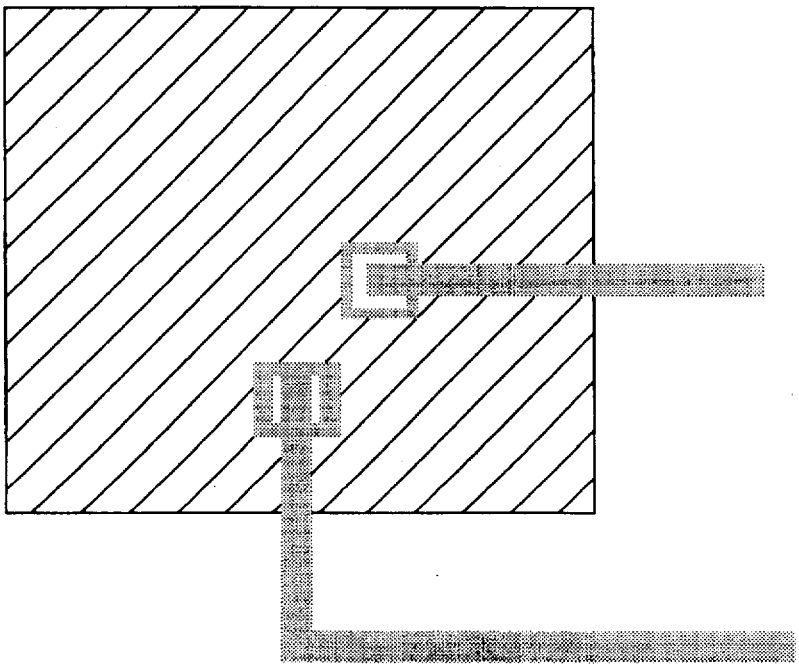

FIGS. 2A and 2B are views illustrating the front side and the rear side of the microstrip disk type antenna.

Advantages of the polarization diversity device according to the present invention are as follows. First, in comparison with the conventional diversity, which is required to use two antennas for reducing the fading effect, the polarization diversity according to the present invention requires the use of only one antenna. Second, the present invention uses a technique for combining two signals at the very back of the antenna, not a conventional selection technique, so that the circuit can be embodied simply. Third, since the present invention uses a microstrip, the cost of manufacture according to circuit design can be reduced considerably.

What is claimed is:

1. A polarization diversity device for reducing a fading effect during radio reception, comprising:

a microstrip disk antenna outputting a first signal received at a first position in the form of a field dipole polarized in a direction of X, and outputting a second signal received at a second position in the form of a field dipole polarized in a direction of Y;

a phase shifter for generating a phase-shifted signal by phase-shifting said second signal; and a combiner for generating a combined signal by combining said first signal with said phase-shifted signal.

2. The polarization diversity device as set forth in claim 1, further comprising a low noise amplifier for amplifying said combined signal to improve reception sensitivity.

3. The polarization diversity device as set forth in claim 1, said first and second positions each comprising an impedance of 50 ohms.

4. The polarization diversity device as set forth in claim 1, said first and second positions are orthogonal to each other.

5. A method for reducing a fading effect during radio reception using polarization diversity device, said method comprising the steps of:

obtaining a first signal from a first position on a microstrip antenna;

obtaining a second signal from a second position on said microstrip antenna;

generating a phase-shifted signal by phase-shifting said second signal; and generating a combined signal by combining said first signal with said phase-shifted signal.

6. The method as set forth in claim 5, further comprising a step of low pass filtering said combined signal.

7. A polarization diversity device for reducing a fading effect during radio reception using a microstrip disk antenna, said polarization device comprising:

a first polarized field dipole for outputting a first signal received by said antenna;

a second polarized field dipole for outputting a second signal received by said antenna;

a phase shifter for generating a phase-shifted signal by phase-shifting said second signal; and a combiner for generating a combined signal by combining said first signal with said phase-shifted signal.

8. The polarization diversity device as set forth in claim 7, further comprising a low noise amplifier for amplifying said combined signal to improve reception sensitivity.

9. The polarization diversity device as set forth in claim 7, said first and second polarized field dipoles being connected to said antenna at respective positions, each said position having an impedance of 50 ohms.

10. The polarization diversity device as set forth in claim 7, further comprising:

said first polarized field dipole having a first direction of polarization; and said second polarized field dipole having a second direction of polarization, said second direction of polarization being orthogonal to said first direction of polarization.

* * * * *